US007219716B2

(12) United States Patent
Oh et al.

(10) Patent No.: US 7,219,716 B2
(45) Date of Patent: May 22, 2007

(54) HEAT EXCHANGER

(75) Inventors: Sai Kee Oh, Seoul (KR); Cheol Soo Ko, Goonpo-si (KR); Dong Yeon Jang, Siheung-si (KR); Yong Cheol Sa, Anyang-si (KR); Se Yoon Oh, Seoul (KR); Baik Young Chung, Incheon-si (KR)

(73) Assignee: LG Electronics, Inc., Seoul (KR)

( * ) Notice: Subject to any disclaimer, the term of this patent is extended or adjusted under 35 U.S.C. 154(b) by 383 days.

(21) Appl. No.: 10/755,371

(22) Filed: Jan. 13, 2004

(65) Prior Publication Data

US 2005/0056407 A1 Mar. 17, 2005

(30) Foreign Application Priority Data

Sep. 15, 2003 (KR) ..... 10-2003-0063677

(51) Int. Cl.
*F28F 1/32* (2006.01)

(52) U.S. Cl. ..... 165/151; 165/182; 165/DIG. 504

(58) Field of Classification Search ..... 165/151, 165/182

See application file for complete search history.

(56) References Cited

U.S. PATENT DOCUMENTS

| | | | | | |
|---|---|---|---|---|---|
| 3,645,330 | A | * | 2/1972 | Albright et al. | 165/151 |
| 3,796,258 | A | * | 3/1974 | Malhotra et al. | 165/151 |
| 4,300,629 | A | * | 11/1981 | Hatada et al. | 165/151 |
| 4,691,768 | A | * | 9/1987 | Obosu | 165/151 |
| 4,923,002 | A | * | 5/1990 | Haussmann | 165/151 |
| 5,056,594 | A | | 10/1991 | Kraay | |
| 5,207,270 | A | * | 5/1993 | Yokoyama et al. | 165/151 |

FOREIGN PATENT DOCUMENTS

| | | | | |
|---|---|---|---|---|
| EP | 0 268 831 | A1 | | 6/1988 |
| JP | 56023699 | A | * | 3/1981 |
| JP | 61-159094 | A | | 7/1986 |
| JP | 61153498 | A | * | 7/1986 |
| JP | 01095294 | A | * | 4/1989 |
| JP | 02029597 | A | * | 1/1990 |
| JP | 2-275295 | A | | 11/1990 |
| JP | 02275295 | A | * | 11/1990 |
| JP | 04015492 | A | * | 1/1992 |
| JP | 6-26778 | A | | 2/1994 |

* cited by examiner

*Primary Examiner*—Allen J. Flanigan
(74) *Attorney, Agent, or Firm*—Birch, Stewart, Kolasch & Birch, LLP

(57) ABSTRACT

Disclosed is a heat exchanger including: a plurality of tubes through which refrigerants flow, the tubes being spaced away from one another; and a fin through which the tubes are perpendicularly inserted, and having a fin collar for supporting the inserted tube, a seat for supporting an outer circumference of a lower end of the fin collar, and three or more peak portions and three or more valley portions that are alternately disposed at an area defined between the tubes to cause air flow to vary at an area defined between the fin collar, heights of at least two peak portions or depths of at least two valley portions being different from each other.

9 Claims, 11 Drawing Sheets

HEAT EXCHANGER

This Nonprovisional application claims priority under 35 U.S.C. § 119(a) on Patent Application No(s). 10-2003-0063677 filed in KOREA on Sep. 15, 2003, the entire contents of which are hereby incorporated by reference.

BACKGROUND OF THE INVENTION

1. Field of the Invention

The present invention relates to a heat exchanger, and more particularly, to a heat exchanger that is designed to effectively guide air flowing along fins disposed between tubes up to rear ends of the tubes.

2. Description of the Related Art

Generally, a heat exchanger is installed in an air conditioner and functions as an evaporator or a condenser for performing a heat exchange between a refrigerant and air. A fin-tube type heat exchanger is widely used among various kinds of the heat exchanger.

In the fin-tube type heat exchanger, the fins installed in a tube for air flow are classified into a slit fin, a louver fin, and a corrugate fin that is formed in a W-shape.

FIG. 1 shows a conventional heat exchanger having the corrugate fin.

Referring to FIG. 1, a heat exchanger 1 includes a plurality of corrugate fins 10 spaced away from each other at a predetermined distance and formed in a W-shape, and a plurality of tubes 30 disposed penetrating the corrugate fins 10 at right angles and along which a refrigerant flows.

Here the fin 10 is provided with peak portions 12 and valley portions 14 at which the tubes are not penetrated and which are intersected with each other at a predetermined angle, a plurality of fin collars 16 defining tube insertion holes through which the tubes are inserted, and a plurality of seats 18 formed in a concentric circle shape to support the fin collars 16.

Herein, the conventional heat exchanger having the corrugate fin will be described with reference to FIGS. 1 to 4.

Referring to FIG. 1, the heat exchanger 1 is a fin-tube type, and a plurality of fins 10 and a plurality of tubes are intersected with each other in a perpendicular direction. The tubes 30 arranged in two rows penetrate the plurality of fins 10 in a perpendicular direction.

Each of the fins 10 is the corrugate fin (hereinafter, abbreviated a fin). Each of the fins 10 has a plurality of donut-shaped flat portions and a plurality of inclined portions that are defined by the W-shape having a plurality of the peak and valley portions. The fins 10 are installed on the tubes 30 in a longitudinal direction of the tubes 30, being spaced away from each other at a predetermined distance.

Referring to FIGS. 2 and 3, there is shown a detailed structure of the fin 10. The fin 10 is formed in a W-shape with the peak and valley portions 12 and 14 that are alternately formed. That is, the fin 10 has two side ends that are respectively defined by the valley portions 14*a* and 14*c*. In case a plurality of fins 10 are used, the tubes 30 are arranged in two rows in a zigzag-shape in order to improve a heat exchange efficiency.

That is, each of the fins 10 installed on the tube 30 has two peak portions 12*a* and 12*b* and three valley portions 14*a*, 14*b* and 14*c*, which are alternately disposed and connected by inclined surfaces. The shape of the fin 10 is symmetrical based on the longitudinal valley portion 14*b*. Central axes of the zigzag-shaped tube 30 pass through the longitudinal center valley portion 14*b*.

The fin 10 is provided with a plurality of tube insertion holes 16*a*, central axes of which correspond to the respective central axes of the zigzag-shaped tube 30. The fin collars 16 are elevated from the fin 10 to define the tube insertion holes 16*a* through which the zigzag-shaped tube 30 is inserted. The tube 30 surface-contacts an inner circumference of each collars 16.

The seat 18 is formed in a concentric circle shape around a lower end of an outer circumference of the fin collar 16 to support the fin collar 16 and to allow air to flow in the form of enclosing the tube 30 and the fin collar 16.

An inclined portion 20 is formed on the fin 20 around the seat 18 to prevent the air flowing around the tube 30 from getting out of a circumference of the tube 30. The inclined portion 20 is inclined upward from the seat 18 to the adjacent peak portions 12.

The seat 18 is located on a horizontal level identical to that where the valley portions 14 are located. Heights and depths H1 and H2 of the peak and valley portions 12 and 14 are identical to each other. That is, the H1 indicates the heights of the adjacent peak portion 12 from the valley portions 14, and the H2 indicates the depths of the adjacent valley portion 14 from the peak portion 12. In addition, the inclined surfaces connecting the valley portions to the peak portions are inclined at an identical angle (θ).

FIGS. 4(*a*) and 4(*b*) are respectively front and rear views of the fin, in which the peak portions 12 and valley portions 14 depicted in FIG. 4(*a*) correspond to the valley portions 14 and peak portions 12 depicted in FIG. 4(*b*), respectively.

When the air is introduced into the heat exchanger 1, the growth of a frost formed on an outer surface of the fin 10 is proportional to an amount of a heat transfer on the outer surface of the fin 10. At this point, the air flow speed is increased at the tube area as well as at the fin areas between the tubes 30 disposed in a longitudinal direction, thereby forming a high-speed air flow. As a result, the heat transfer coefficient is increased and the frost layer is quickly grown on the surface of the fin 10.

In case the frost layer is grown on the surface of the fin 10, since the distance between the adjacent fins 10 is reduced, an air passage area is also reduced. Due to the reduced area, the air flow speed is increased much more. As a result, the pressure drop of the air is increased in a parabola shape as time passes. Further, the heat transfer amount of the heat exchanger is also greatly reduced.

SUMMARY OF THE INVENTION

Accordingly, the present invention is directed to a heat exchanger that substantially obviates one or more problems due to limitations and disadvantages of the related art.

A first object of the present invention is to provide a heat exchanger that can improve the heat discharge efficiency by designing a corrugate fin such that heights between peak portions and valley portions that are formed on a left or right side of a reference line of a fin center portion through which central axes of the tube perpendicularly passes become different from one another.

A second object of the present invention is to provide a heat exchanger including a fin bent in a zigzag-shape such that heights and depths of outer peak and valley portions are greater than those of inner peak and valley portions.

A third object of the present invention is to provide a heat exchanger including a fin bent in a zigzag-shape such that heights of outer peak portions are greater than those of inner peak portions to increase a speed of air flowing along the fin between tubes.

A fourth object of the present invention is to provide a heat exchanger including a fin where an inner angle of a center peak portion is greater than that of an outer peak portion.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heat exchanger including a plurality of tubes through which refrigerants flow, the tubes being spaced away from one another; and a fin through which the tubes are perpendicularly inserted, and having a fin collar for supporting the inserted tube, a seat for supporting an outer circumference of a lower end of the fin collar, and three or more peak portions and three or more valley portions that are alternately disposed at an area defined between the tubes to cause air flow to vary at an area defined between the fin collar, heights of at least two peak portions or depths at least two valley portions being different from each other.

According to another aspect of the present invention, there is provided a heat exchanger including a plurality of tubes through which refrigerants flow, the tubes being spaced away from one another; and a plurality of fins spaced away from one another at a predetermined distance, and each of the fin including a fin collar through which tube is perpendicularly inserted, and peak portions where a height of an inner horizontal plane is lower than a height of an outer horizontal plane and valley portions alternately disposed and inclined to cause an air flow direction to vary at an area defined between the fin collar.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIGS. 5 to 11 show a preferred embodiment of the present invention.

Figure 1:
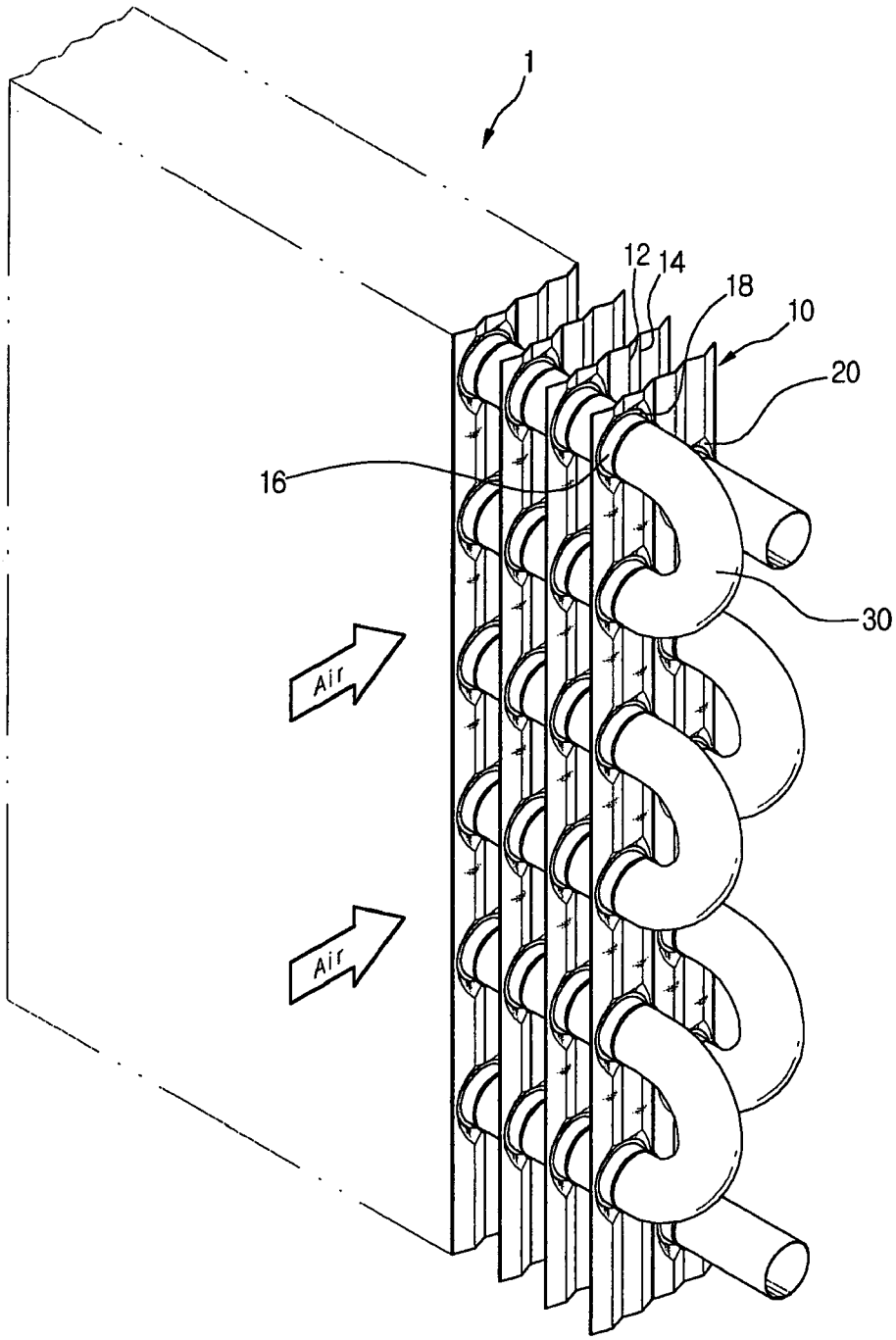
Fig.1 Related Art
FIG. 1 is a perspective view of a conventional heat exchanger.
Figure 2:
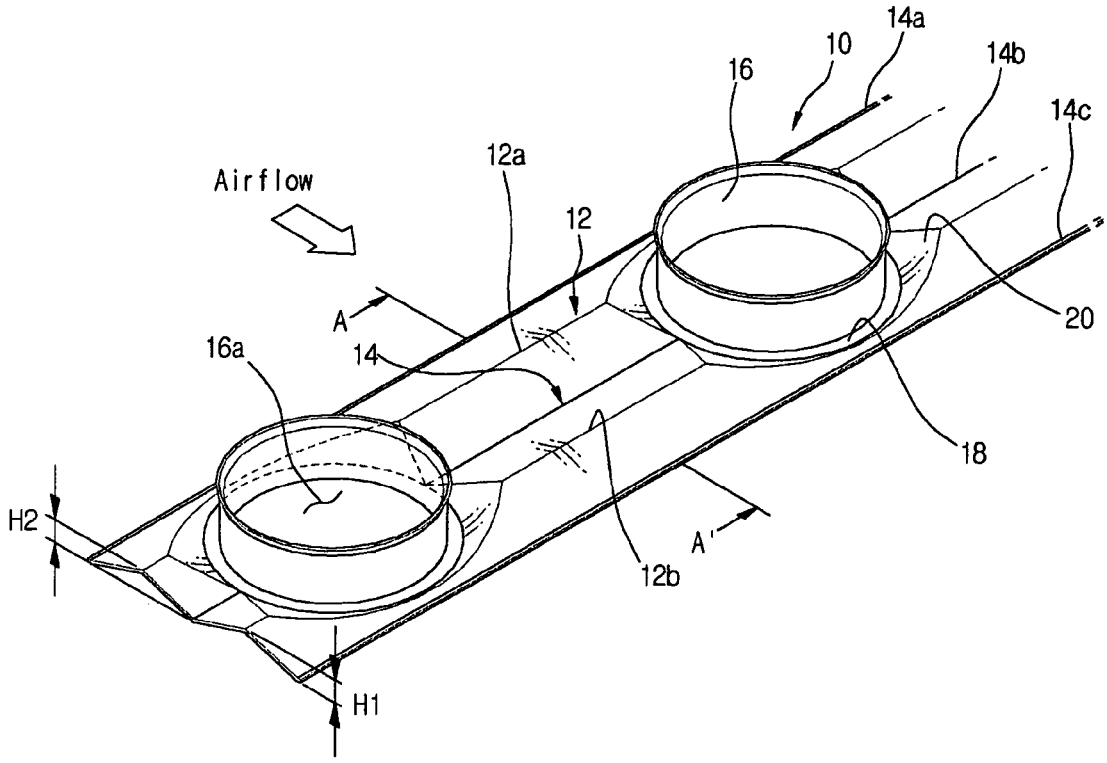
Fig.2 Related Art
FIG. 2 is a perspective view of a fin depicted in FIG. 1.
Figure 3:
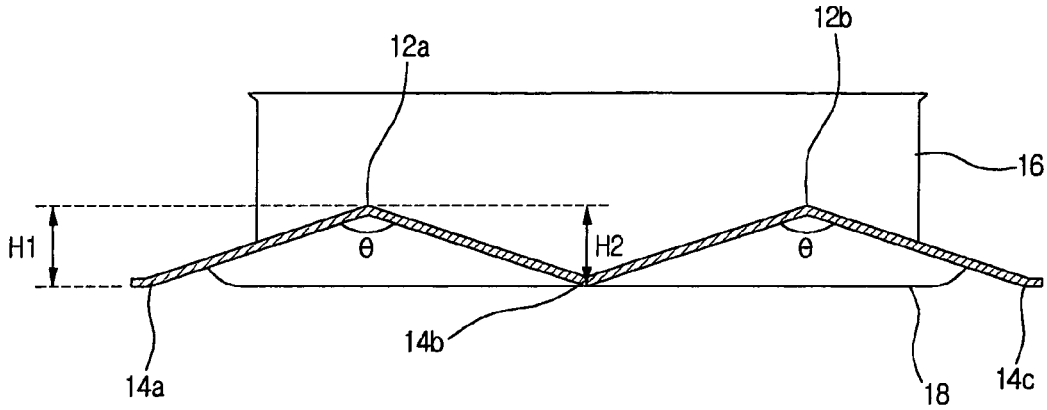
Fig.3 Related Art
FIG. 3 is a sectional view taken along the line A–A' of FIG. 2.
Figure 4A:
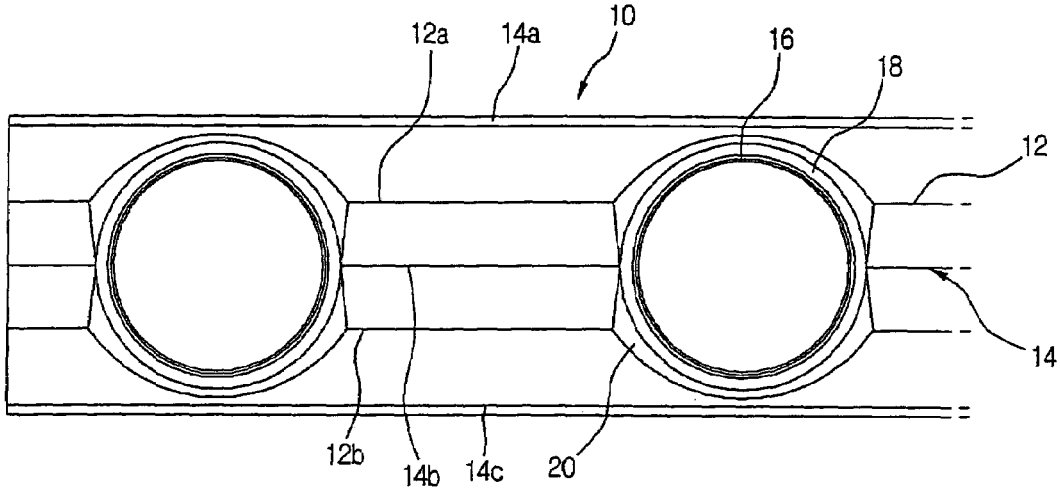
Fig. 4A Related Art
FIG. 4*a* is a front view of the fin depicted in FIG. 2.
Figure 4B:
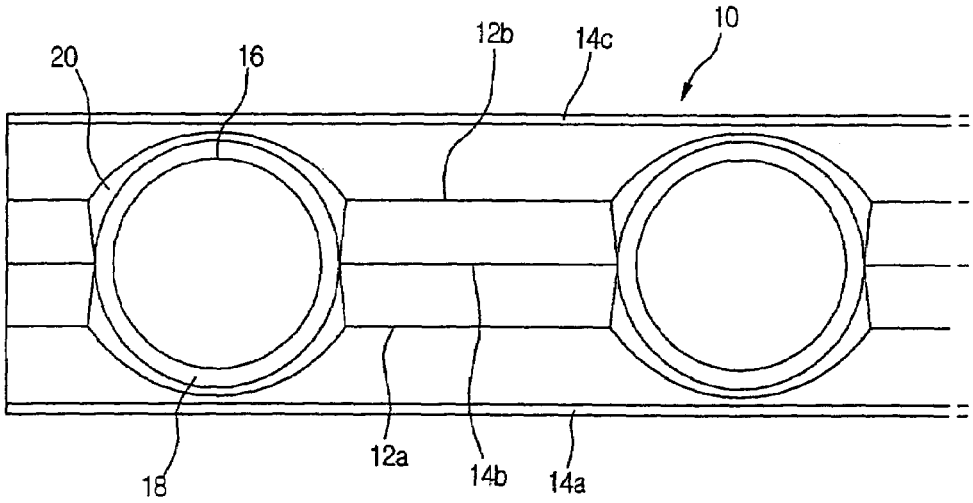
Fig. 4B Related Art
FIG. 4*b* is a rear view of the fin depicted in FIG. 2.
Figure 5:
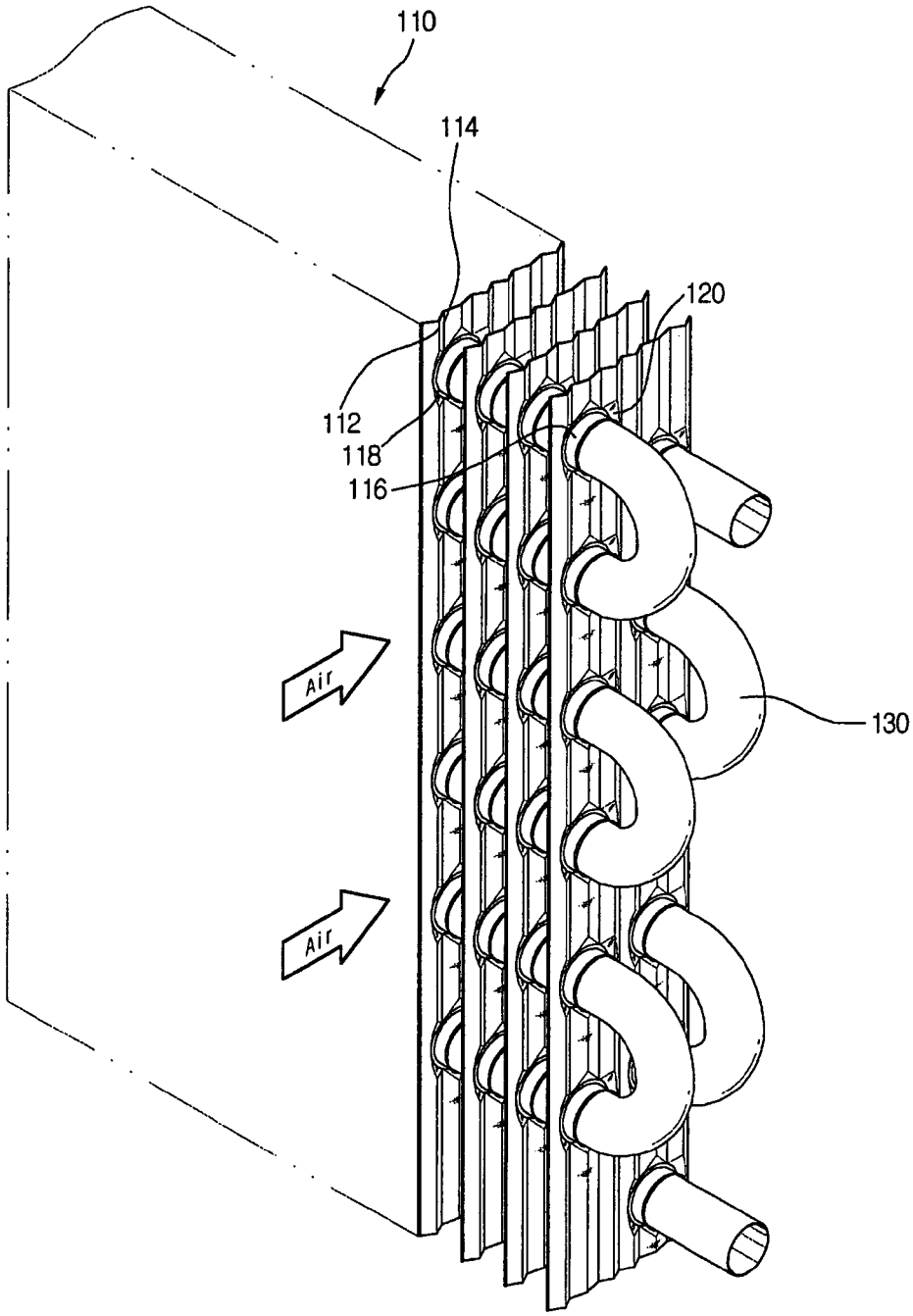
FIG. 5 is a perspective view of a heat exchanger according to a preferred embodiment of the present invention.
Figure 6:
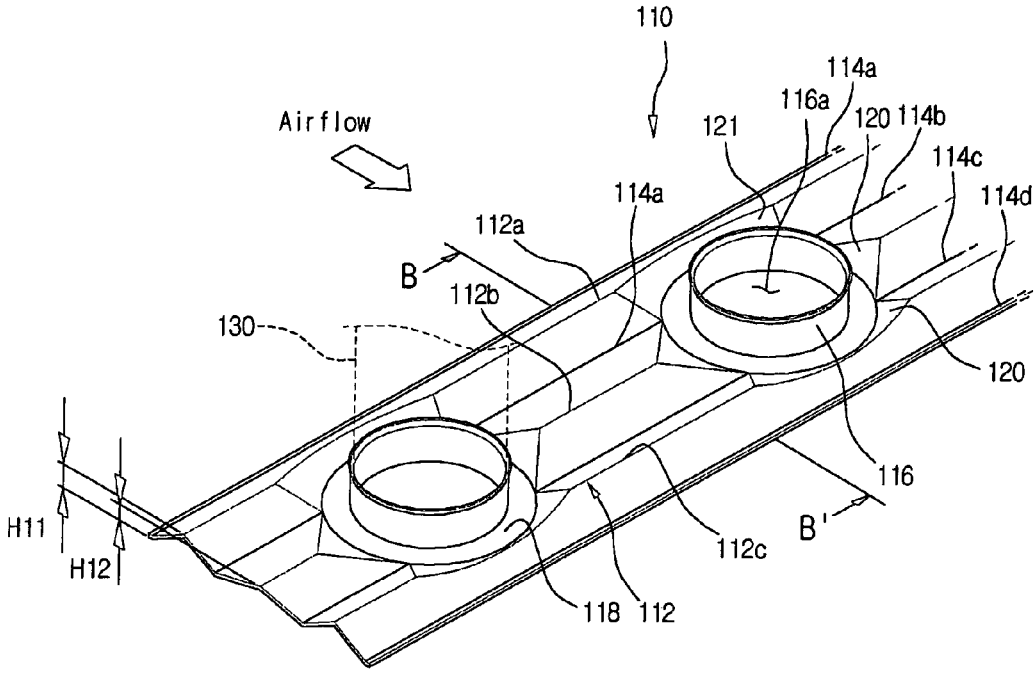
FIG. 6 is a perspective view of the fin depicted in FIG. 5.
Figure 7:
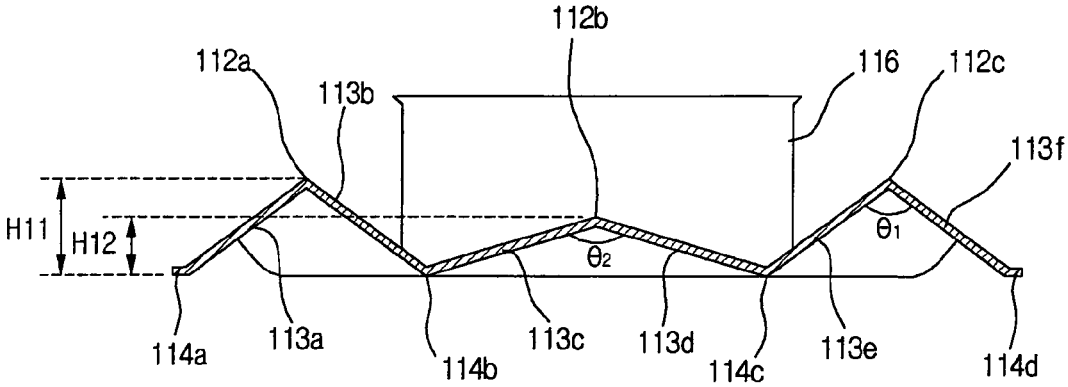
FIG. 7 is a sectional view taken along the line B–B' of FIG. 6.

Referring first to FIGS. 5 to 7, the inventive heat exchanger 101 includes a plurality of fins 110 spaced away from one another at a predetermined distance and a plurality of tubes 130, along which a refrigerant flows, disposed penetrating the fins 110 at right angles.

The fin 110 is formed in an inversed W-shape. That is, the fin 110 includes first, second and third peak portions 112 (112*a*, 112*b* and 112*c*), first, second, third and fourth valley portions 114 (114*a*, 114*b*, 114*c* and 114*d*), fin collars 116 formed defining tube insertion holes 116*a* through which the tubes 130 perpendicularly pass, seats 118 for supporting outer circumference surfaces of lower ends of the fin collars 116, and inclined portions 120 inclined upwardly from outer circumferences of the seats 118 to the peak portions 112.

The peak portions 112 and the valley portions 114 are alternately formed between the fin collars 116 and are connected to one another by surfaces inclined at predetermined inclination angles θ1 and θ2 that are different from each other.

For variation of air flow, a height (H12) of the second peak portions 112*b* can be designed to be lower than heights (H11) of the first and third peak portions 112*a* and 112*c*, or contrarily the heights (H11) of the first and third peak portions 112*a* and 112*c* can be designed to be higher than the height (H12) of the second peak portions 112*b*. Due to undulated elements for air flow variation, the air flowing between the tubes can be more effectively guided up to rear ends of the tubes 30.

The operational effect of the heat exchanger according to the preferred embodiment of the present invention will be described hereinafter.

As shown in FIGS. 5 to 8, the heat exchanger 301 is a fin-tube type in which a plurality of corrugate fins each formed in a W-shape are perpendicularly disposed with respect to the tubes 130 and are spaced away from one another at a predetermined distance.

Each of the fins 110 is divided into a fin collar area through which the tubes 130 penetrate and an inclined surface area defined between the fin collars 116. The heights and depths of the peak portions and valley portions are different from each other to let the flow of the air introduced into the heat exchanger changed.

That is, inclined angles θ1 and θ2 of the inclined surfaces connecting the alternately disposed peak portions 112 and valley portions 114 are different from each other. For the more effective air incoming and outgoing operation, the fin 110 is designed having both side ends defined by the first and fourth valley portions 114*a* and 114*d*. That is, the fin 110 starts with the valley portion 114*a* and ends with the valley portion 114*d* in a lateral direction.

In addition, the fin 110 is designed to be symmetrical based on the center peak portion 112*b*. That is, the left and right portions based on the central peak portion 112*b* are symmetrical, and the heights and depths of the peak portions and valley portions formed on each of the left and right portions are different from each other.

As shown in FIG. 7, the valley portions 114*a*–114*d* are located on an identical horizontal plane, and the peak portions 112*a*–112*d* are located on a different horizontal plane.

The first peak portion 112*a* is connected to the surfaces 113*a* and 113*b* inclined at the predetermined angle θ1 between the first valley portion 114*a* with which the fin starts and the second valley portion 114*b*. The second peak portion 112*b* is connected at the different angle θ2 to the inclined surfaces 113*c* and 113*d* between the second valley portion 114*b* and the third valley portion 114*c*. The third peak portion 112*c* is connected at the different angle θ1 to the inclined surfaces 113*e* and 113*f* between the third valley portion 114*c* and the fourth valley portion 114*d* with which the fin ends.

At this point, the height of the inner peak portion 112*b* is designed to be different from heights of the outer peak portions 112*a* and 112*c*.

That is, as shown in FIGS. 6 and 7, the valley portions 114 are located on the identical horizontal plane, and the peak portions 112 are located having different heights H11 and H12. That is, the height H12 of the center peak portion 112*b* is formed to be lower than the heights H11 of the outer peak portions 112*a* and 112*c*.

Herein, the left and right portions based on the center peak portion 112*b* are symmetrical, and the heights of the peak portions 112*a* and 112*c* and the depths of the valley portions (114*a*, 114*b*) and (114*c*, 114*d*) formed on each of the left and right portions are different from each other.

For example, the height H12 from the horizontal plane where the inner peak portions 112*b* is located to the inner peak portions 114*b* and 114*c* is designed to be lower than the depths H11 from the horizontal plane to the outer valley portions 114*a* and 114*d*.

That is, the heights H11 of the first and third peak portions 112*a* and 112*c* are the same as each other, and the height H12 of the second peak portion 112*b* is different from the height H11. Accordingly, the height H12 of the second peak portion 112*b* is formed to be lower than the heights of the first and third peak portions 112*a* and 114*c*.

By the above-described structure, the air flow of the air introduced into areas defined between the fins 110 is varied due to the fin structure where the inner peak portion 112*b* is lower than the outer peak portions 112*a* and 112*c*. That is, the air flow of the air introduced into and then escaped from areas defined between the fins 110 is greatly varied when compared with the conventional art Therefore, the air can be more effectively guided up to the rear ends of the tubes 30. In addition, the pressure drop is reduced for the high-speed air flow and an amount of the heat transfer is increased.

In more detail, when the heights H11 from the horizontal plane where the first valley portion 114*a* is located to the first and third peak portions 112*a* and 112*c* are the same as each other, the height H12 from the horizontal plane where the first valley portion 114*a* is located to the second peak portion 112*b* is lower than the heights H11 of the first and third peak portions 112*a* and 112*c*.

Meanwhile, the fin collars 116 are spaced away at a predetermined distance in a longitudinal direction of the fin 110 and are penetrated by each of the tubes 130. The fin collars 116 define tube insertion holes 116*a* each having a diameter corresponding to an outer diameter of the tube to support the tube 130 inserted therein.

In addition, the seat 118 formed around a lower end of an outer circumference of the fin collar 116 has a predetermined width to support the fin collar 116. The seat 118 is disposed on a horizontal plane identical to that where the second and third valley portions 114*b* and 114*c* are located.

The inclined portions 120 inclined upwardly from outer circumferences of the seat to the peak portions 112. That is, each of the inclined portions 120 is defined by connecting each of the peak portion 112*a* to the valley portions 114*b* and 114*c* contacting the outer circumference of the seat 118 and adjacent to the peak portions 112*a*, thereby being formed in a triangular-shape. The inclined portions 120 guide the air to flow along the outer circumference of the fin collars 116.

In addition, the inclined portions 120 may be further formed by connecting two points of each outer peak portion (the first and third peak portions 112*a* and 112*c*) to two points of each inner adjacent valley (the second and third valleys 114*b* and 114*c*) contacting the seat 118. In this case, the inclined portions 120 are formed in a rectangular-shape.

The inclined portions 120 respectively function as a wall enclosing the fin collar 116.

In the above-described present invention, the height H12 from the horizontal plane where the valley portion 114 is located to the inner peak portion 112*b* should be lower than the heights H11 of the outer peak portions 112*a* and 112*c*. For example, one or more inner peak portions should be lower than the outer peak portion in height.

Figure 8A:
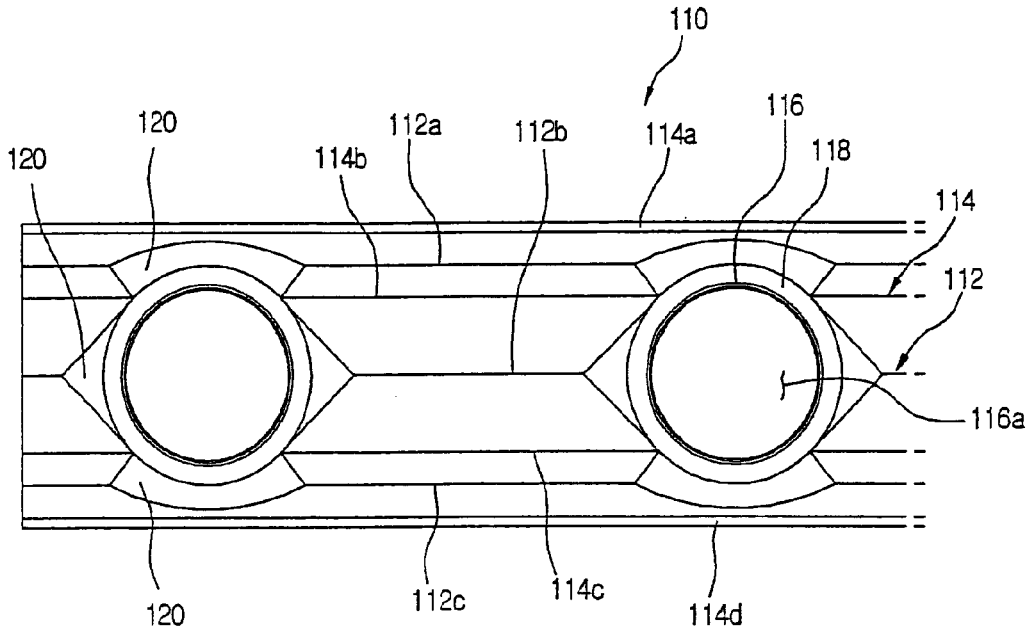
FIG. 8*a* is a front view of the fin depicted in FIG. 6.
Figure 8B:
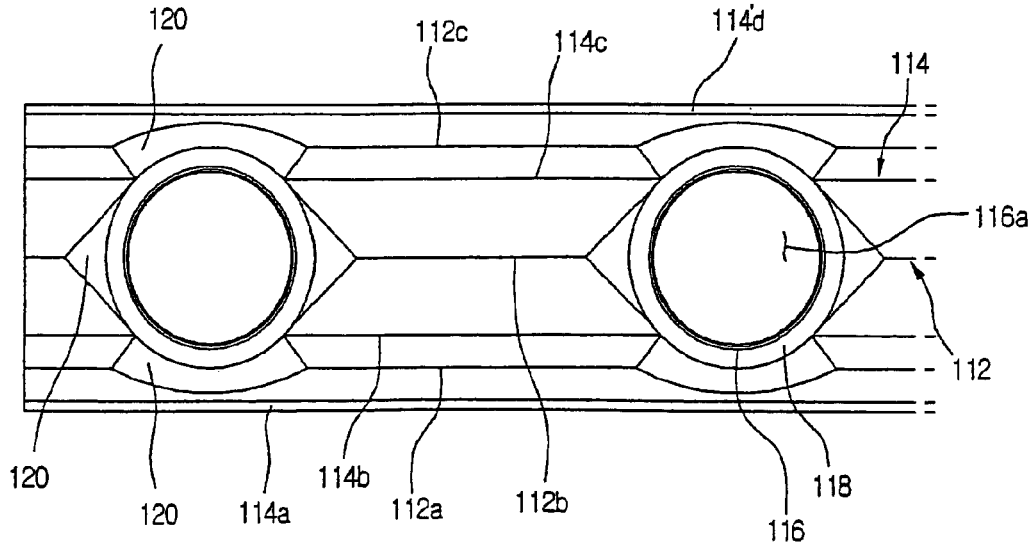
FIG. 8*b* is a rear view of the fin depicted in FIG. 6.

FIGS. 8*a* and 8*b* respectively show front and rear views of the fin according to the preferred embodiment of the present invention.

The peak portions and the valley portions that are depicted in FIG. 8*a* become the valley portions and the peak portions in FIG. 8*b*, respectively. That is, when being viewed in FIG. 8*b*, the depths from the horizontal plane where the peak portions are located to the valley portions are different from one another.

Figure 9:
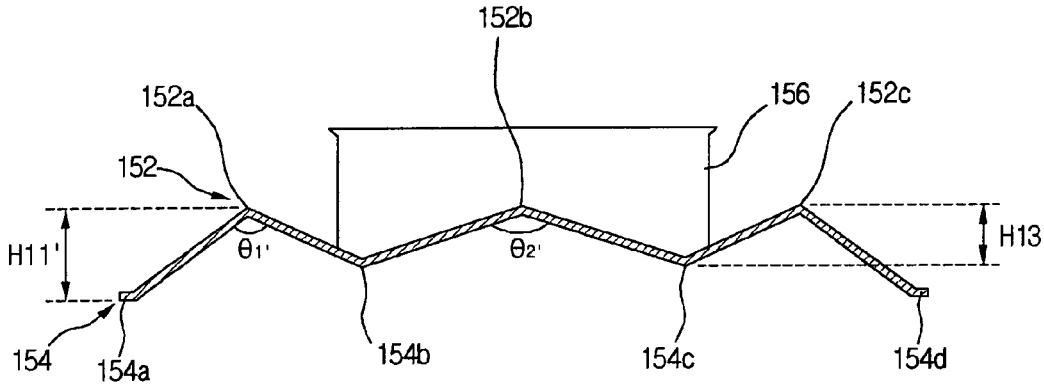
FIG. 9 are views illustrating modified examples similar to that depicted in FIG. 7.

FIG. 9 shows a modified example of the preferred embodiment.

In this modified example, first, second, third and fourth peak portions 152 (152*a*, 152*b* and 152*c*) are located on an identical horizontal plane. The depth H13 from the horizontal plane where the peak portion 152 is located to the inner valley portions 154*b* and 154*c* is lowered than the depths of the outer valley portions 154*a* and 154*b*. That is, H11' is higher than H13. Further, an inner angle θ1' of the first peak portion 152*a* is smaller than an inner angle θ2'.

Accordingly, the present invention has an effect in that a pressure drop is reduced and the heat transfer amount is increased relatively when H11 does not equal to H12 and H11' does not equal to H13 compared with when H11 does equal to H12.

For example, an inclination structure can be formed where a specific valley portion or peak portion is located on the same horizontal plane, and the heights from the same horizontal planes to the peak portion or the valley portion are gradually lowered going into the areas defined between the fins, and gradually increased going from the areas defined between the fins.

In the above-described preferred embodiment, since the peak or valley portions are designed having a different height or depth, a contacting area with the air is increased, increasing the air flow variation.

Figure 10:
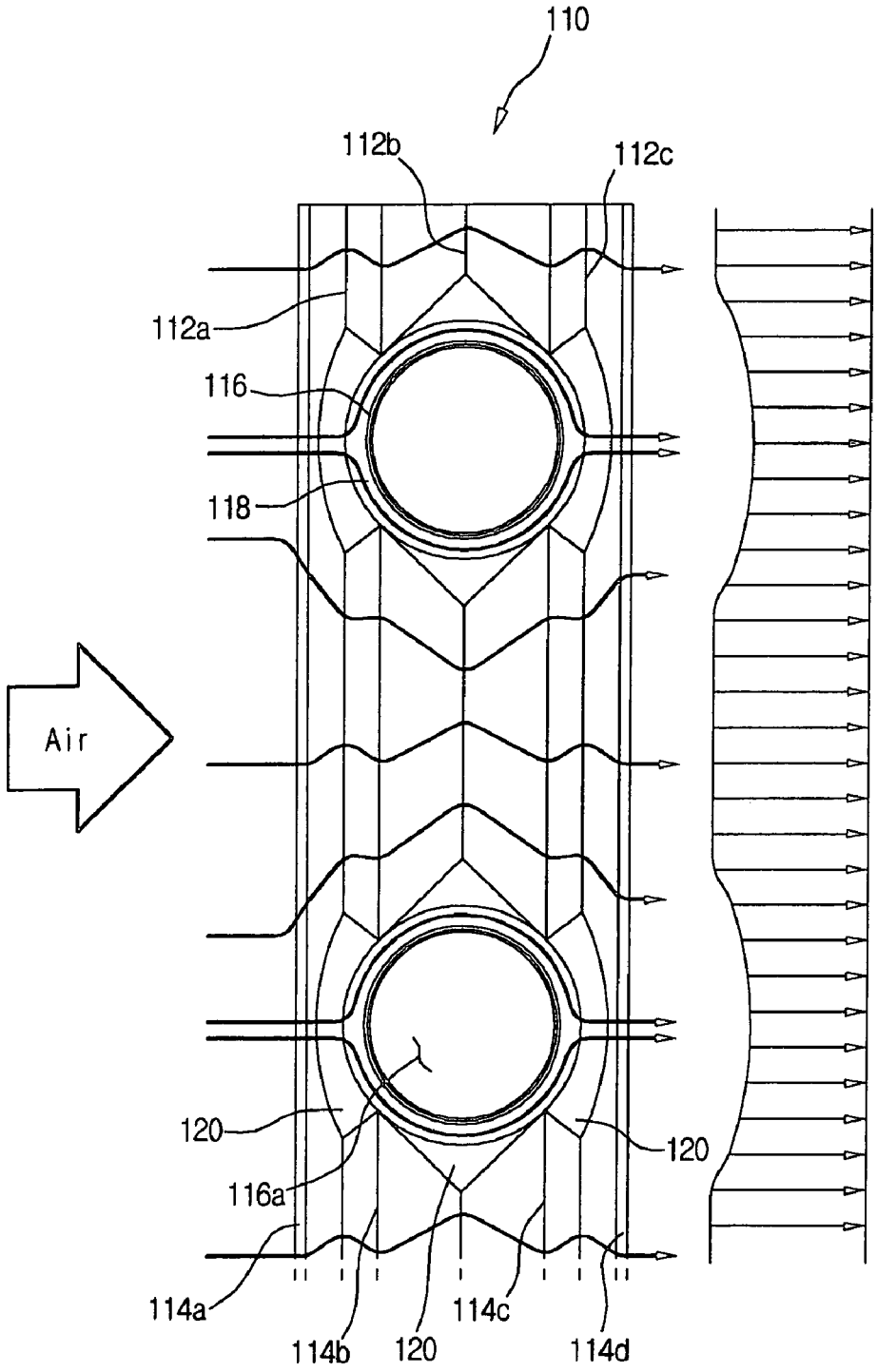
FIGS. 10 and 11 are views illustrating air flow states in a heat exchanger according to a preferred embodiment of the present invention.
Figure 11:
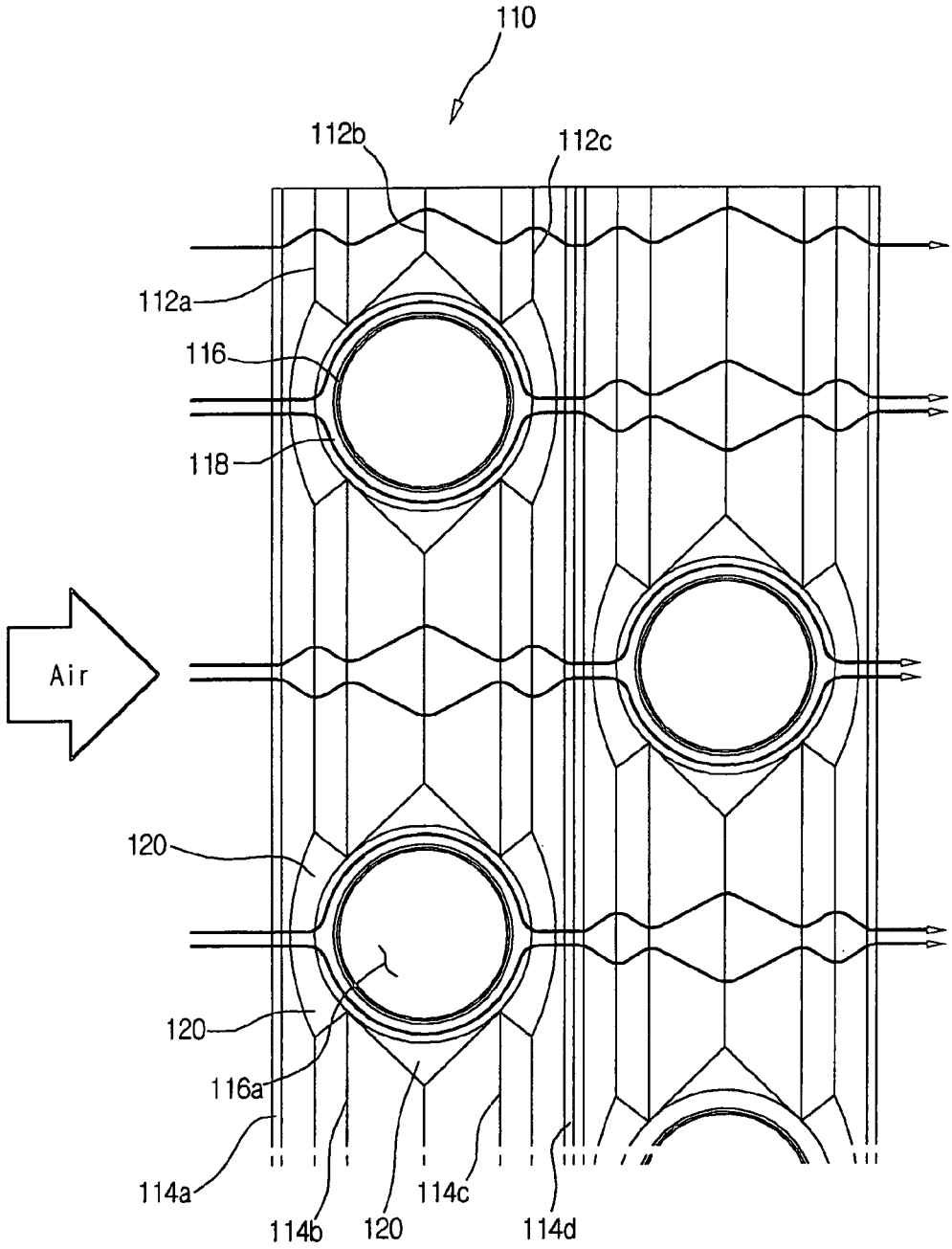

FIGS. 10 and 11 show an air flow state of the heat exchanger according to the preferred embodiment. FIG. 10 is a case where the fin is formed of a single fin structure, and FIG. 11 is a case where the fin is formed of a dual fin structure.

As shown in FIG. 10, when outer air is introduced into the heat exchanger, since the air quickly flows between the tubes while it repeatedly ascends and descends along the peak and valley portions 112 and 114, the contacting area between the air and the fins is increased.

That is, the air is introduced through the first valley portion 114*a* and the second peak portion 112*a*. The flow of the air introduced through the first peak portions 112*a* is varied as it further flows along the inner valley portions 114*b* and 114*c*, and peak portion 112*b*. As a result, the air flow speed is increased such that the air flow is sent to the peak portion 112*c* and the valley portion 114*d* at an outlet side, thereby increasing the heat transfer efficiency.

Furthermore, since the heights H11 of the first and third peak portions 112*a* and 112*c* that are located on inlet and outlet sides of the air, respectively, are higher than those H12 of the second peak portion 112*b*, the distance between the adjacent fins 110 is increased to thereby increase the air passage area. As a result, the pressure drop is reduced for the high-speed air flow to thereby increase the amount of heat transfer and reduce the overall pressure drop of the heat exchanger.

In addition, since the fin collars, seats and inclined portions are formed around the tube insertion holes through which the tube is inserted, the air can be guided up to the rear end of the tube along the curvatures of the tube and the inclined portions.

In more detail, when the air passes between the tubes 130 with a high-speed, the high-speed air flow increases the heat transfer and retards the growth of the frost layer. Accordingly, a high level of heat capacity is maintained even under the frost forming condition, thereby increasing the heat exchange capability and making it possible to run the heat exchanger for a long term.

FIG. 11 shows an air flow state when the fins are formed in a dual fin structure and the tubes are perpendicularly installed on the fins in a zigzag-shape. Since the tubes are arranged in the zigzag-shape, when the air passes through a tube area and a none-tube area (area between the tubes), the air flow is realized as in the case where the fin is formed of a single fin plate.

In the above-described preferred embodiment, since the heights or depths of the inner peak and valley portions are lower than those of the outer peak and valley portions that are disposed on inlet and outlet sides of the air, the air can quickly flow between the tubes, the air can be effectively guided up to the rear end of the tube. In addition, since the pressure drop is reduced for the fast flow speed of the air flowing between the tubes while the heat transfer amount and heat exchange amount are increased, thereby improving the overall efficiency of the heat exchanger.

As described in the above embodiments, by varying the design of the fins, the overall heat transfer efficiency can be improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heat exchanger comprising:

a plurality of tubes through which refrigerants flow, the tubes being spaced away from one another; and a fin through which the tubes are perpendicularly inserted, the fin including:

a fin collar for supporting the inserted tube, and a plurality of peak portions and valley portions that are alternately disposed in a first direction at an area defined between the tubes, the peak portions and the valley portions extending along a second direction, the fin collar and a first one of the peak portions being located in between a second one of the peak portions and a third one of the peak portions along the second direction, the first one of the peak portions having a different height from the second one of the peak portions and the third one of the peak portions, the valley portions being substantially coplanar.

2. The heat exchanger according to claim 1, wherein the fin is a corrugated fin having an inversed W-shape.

3. The heat exchanger according to claim 1, wherein the fin starts with an one-side outer valley portion and ends with an other-side outer valley portion with reference to an air flow direction at the area defined between the fin collar.

4. A heat exchanger comprising:

a plurality of tubes through which refrigerants flow, the tubes being spaced away from one another; and a fin through which the tubes are perpendicularly inserted, and having a fin collar for supporting the inserted tube, a seat for supporting an outer circumference of a lower end of the fin collar, and three or more peak portions and three or more valley portions that are alternately disposed at an area defined between the tubes to cause air flow to vary at an area defined between the fin collar, heights of at least two peak portions or depths of at least two valley portions being different from each other, wherein the valley portions are located on a horizontal plane with reference to the air flow direction, and heights from the horizontal plane to the peak portions located between the valley portions are different from each other.

5. The heat exchanger according to claim 1, wherein the first one of the peak portions is lower than the second one and the third one of the peak portions.

6. The heat exchanger according to claim 5, wherein the first one of the peak portions is the only one of the peak portion located in between the second one of the peak portions and the third one of the peak portions along the second direction, an interior angle of the first one of the peak portions is larger than an interior angle of at least another one of the peak portions.

7. A heat exchanger comprising:

a plurality of tubes through which refrigerants flow, the tubes being spaced away from one another; and a fin through which the tubes are perpendicularly inserted, and having a fin collar for supporting the inserted tube, a seat for supporting an outer circumference of a lower end of the fin collar, and three or more peak portions and three or more valley portions that are alternately disposed at an area defined between the tubes to cause air flow to vary at an area defined between the fin collar, heights of at least two peak portions or depths of at least two valley portions being different from each other, wherein the peak portions are located on a horizontal plane, and depths from the horizontal plane to the valley portions located between the peak portions are different from each other, wherein the depths of the outer valley portions disposed at air inlet and outlet sides are lower than those of the inner valley portions, and wherein a plurality of inner valley portions are located within the outer valley portions, and the heights of the inner valley portions are the same as one another.

8. The heat exchanger according to claim 7, wherein a plurality of inner valley portions is located between the outer valley portions, and the heights of the inner valley portion are different from one another.

9. A heat exchanger comprising:

a plurality of tubes through which refrigerants flow, the tubes being spaced away from one another; and a fin through which the tubes are perpendicularly inserted, and having a fin collar for supporting the inserted tube, a seat for supporting an outer circumference of a lower end of the fin collar, and three or more peak portions and three or more valley portions that are alternately disposed at an area defined between the tubes to cause air flow to vary at an area defined between the fin collar, heights of at least two peak portions or depths of at least two valley portions being different from each other, wherein a longitudinal centerline of a pin is defined by one of the valley portions, the pin having left and right halves that are symmetrical based on the longitudinal centerline, the heights of the peak portions are increased as they go to an outer side.

* * * * *